US007201110B1

(12) United States Patent
Pawlak

(10) Patent No.: US 7,201,110 B1
(45) Date of Patent: Apr. 10, 2007

(54) PORTABLE FAN REMOVABLY AND ADJUSTABLY MOUNTABLE IN A HATCH

(76) Inventor: John Pawlak, 5315 Melvin A V, Tarzana, CA (US) 91356

( * ) Notice: Subject to any disclaimer, the term of this patent is extended or adjusted under 35 U.S.C. 154(b) by 0 days.

(21) Appl. No.: 11/350,449

(22) Filed: Feb. 8, 2006

(51) Int. Cl.
*B63J 2/00* (2006.01)

(52) U.S. Cl. ..... 114/211; 454/78; 454/136

(58) Field of Classification Search ..... 114/211, 114/212; 454/69, 78, 129, 136, 900
See application file for complete search history.

(56) References Cited

U.S. PATENT DOCUMENTS 1,722,824 A * 7/1929 Roethel ..... 454/136
2,523,933 A * 9/1950 Akester ..... 114/211
4,895,065 A * 1/1990 Lamparter ..... 454/136
4,967,569 A * 11/1990 Machen et al. ..... 62/240
5,344,361 A * 9/1994 Matthias ..... 454/129
6,939,219 B1 * 9/2005 Pollen ..... 114/211

* cited by examiner

*Primary Examiner*—Lars A. Olson
(74) *Attorney, Agent, or Firm*—Donald W. Meeker

(57) ABSTRACT

A portable hatch-mounted fan that is removably mounted to an existing hatch of a boat or a recreational vehicle by a pair of fast action spring-type vertically adjustable clamps, which adjust to fit various hatch frame thicknesses. The clamps, clamp guide plates and guides are also horizontally adjustable on the fan frame to fit various sizes of hatch openings.

20 Claims, 3 Drawing Sheets

PORTABLE FAN REMOVABLY AND ADJUSTABLY MOUNTABLE IN A HATCH

CROSS-REFERENCE TO RELATED APPLICATIONS

Not Applicable

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to air circulation devices and particularly to a portable hatch-mounted fan, which is removably mounted to an existing hatch of a boat or a recreational vehicle by a pair of fast action spring-type vertically adjustable clamps to adjust for various hatch frame thicknesses, which clamps are also horizontally adjustable on the fan frame to fit various sizes of hatch openings.

2. Description of Related Art Including Information Disclosed Under 37 CFR 1.97 and 1.98

During the summer season, when boating and recreational activities are at their height, the cabins of many boats and recreational vehicles (RV's) heat up uncomfortably to over 30 degrees above the ambient outside temperature. In an attempt to rectify the situation and make the cabins more pleasant, the owners open all the hatches and doors and have small fans blowing in the cabins. The fans blow cabin-heated stale air around within the cabin but do not bring in clean fresh air.

There are several versions of fans on the market designed to bring in outside air, which require tedious installation not within the skill level of many owners. In the case of boats, some versions require cutting a hole in the deck to specific dimensions that will accept the fan assembly. In the case of recreational vehicles, the hatches are more standardized to allow installation in an existing hatch cavity in a higher percentage of coaches without cutting the roof. The prior art does not provide a means for bringing fresh air in using a device that does not require major modifications and can be easily adjusted even by unskilled hands to accommodate a specific application.

There are two types of ventilation fans typically used in boats. They are categorized as either battery powered or solar powered. Battery powered fans are small free standing fans or fans that are attached to the walls of the boat. They blow existing cabin air around but do not bring fresh air into the cabin. Open hatches and doors provide minimal fresh air and are totally ineffective if the outside air is still. The result is that on a hot summer day, the cabin heats up and all the cooking odor and musty smells remain. Solar powered fans are extremely limited because the solar cells are so small, they generate little electricity and therefore the fans move very little air in the neighborhood of 1,100 cubic feet per hour. In a 40-foot boat that amounts to one air change every hour—grossly inadequate. They are quite expensive and many require cutting a hole (holes in case of multiple installations) in the deck which many boat owners are reluctant to do.

Recreational vehicle owners are faced with the same problems of odors and heat buildup. Retrofittable 12 volt fan/hatch combinations are available for specific hatch hole sizes which are not universal to all vehicles. They require removal of the existing hatch or a hole can be cut into the roof to accommodate the fan/hatch without disturbing the existing hatches. In both cases, the installation is fairly involved and requires electrical power to be brought to the fan. These fans operate on 12 volts and are effective ventilators. However the issues involved with permanent installation including potential roof leakage are a deterrent to many recreational vehicle owners.

Prior art U.S. Pat. No. 4,633,769, issued Jan. 6, 1987 to Milks, claims a power roof vent fan assembly having a motor and fan mounted in a body spanning an opening in the roof of an enclosure. The motor is mounted in H-shaped cross brace assembly having reinforcing ribs for vibration dampening. A shroud is secured to the body which supports a screen and includes a trim flange which forms a pocket in conjunction with the body. A bezel is telescopically received within the pocket and secured to the lower surface of the roof. A cover is provided over the top end of the assembly which is hinged on one end and adapted to be opened and closed by a cover lifting mechanism located within the pocket. The fan motor is controlled by a speed control switch also located within the pocket. The pocket in which the switch is retained includes ventilation openings for aiding heat dissipation from the switch. The Milks patent is the basis for a commercial fan used primarily in recreational vehicles, which fan fits into a standard opening and requires permanent installation. Since this is an all weather fan, the bezel must be sealed to the roof and power is permanently strung through the ceiling. A cover, which is part of the assembly, is lowered onto the roof from within the RV when unfriendly elements exist outside of the coach. Airflow is 500 to 900 CFM—more than adequate to create good cooling. This fan is even more expensive than the previous.

Prior art U.S. Pat. No. 2,523,933, issued Sep. 26, 1950 to Akester, concerns a ventilating system for ventilating the interior of a ship, said system comprising an aperture through the ship's hull and lining, an air duct passing through said aperture, and a rotary fan mounted within the air duct.

Prior art U.S. Pat. No. 4,967,569, issued Nov. 6, 1990 to Machen, shows portable air-conditioning units for through-hatch marine use which have their conventional air-conditioning mechanisms carried on a base member above the hatch opening and which employs a cover shell enclosing said mechanisms divided into two compartments internally, one compartment not communicating with the outside air which contains a cooling coil and a fan for moving air from a duct which has an opening below the hatch through the coil and back through another duct which also has an opening below the hatch and the other compartment not communicating below the hatch which contains the compressor, a heat exchanger, and another fan for moving outside air through the exchanger. Various shrouds, adjustable supports, and level indicators may be included in the units.

Prior art U.S. Pat. No. D365,873, issued Jan. 2, 1996 to Van Belle, is for the ornamental design for a combined fan housing and hatch cover.

Prior art U.S. Pat. No. 4,300,440, issued Nov. 17, 1981 to Holter, indicates a ventilating hatch assembly for a boat deck or the like that includes a square opening in the deck having a coaming extending therearound. A square frame having a hatch cover pivotally attached along one edge thereof is disposed over the opening and is demountably attached to the coaming. The frame and hatch cover may be removed from the coaming and selectively replaced at one of four ventilating positions spaced at 90.degree. intervals. No fan is provided for use with the Holter ventilating hatch assembly.

Prior art U.S. Pat. No. D266,923, issued Nov. 16, 1982 to Parks, discloses the ornamental design for a ventilating hatch, which has no fan.

Prior art U.S. Pat. No. 2,476,402, issued Jul. 19, 1949 to Cook, puts forth a ventilating hatch for boats, which has no fan. The ventilating hatch has a cover which may be locked into three different positions by a latch means.

Prior art U.S. Pat. No. 5,327,846, issued Jul. 12, 1994 to Androus, describes a wind scoop for directing a flow of air into the interior of a marine craft through an opening such as a hatch on the deck of the marine craft. The wind scoop has an adjustable top cover for preventing rain water from entering the opening while continuing the flow of air to the interior. An alternate embodiment is provided with a fan for further movement of the air.

Prior art U.S. Pat. No. 5,816,909, issued Oct. 6, 1998 to Wunder, provides a dual purpose attic ventilator comprising a hatch with a structure for mounting the hatch on a roof of an attic in a building having an opening therethrough. An attic fan is also provided. A component is for pivoting the attic fan on the hatch. A person can open the attic fan on the hatch to climb out through the hatch onto the roof of the building. The person can close the attic fan on the hatch, to allow the attic fan to pull hot air out of the attic through the hatch.

Prior art U.S. Patent Application #20030129071, published Jul. 10, 2003 by Milks, is for an air circulation device that is capable of producing and directing an air current to a desired location. The air current is used to circulate stagnant air which, in turn, provides a cooling effect. Advantageously, the device is electrically powered by 12-volt direct current (DC) but is capable of producing an air current of a magnitude similar to or greater than that produced by air circulation devices which are powered by 120-volt alternating current (AC). Further, the device contains at least one retractable elongated support which allows the device to stand upright on a flat surface when the support is in an extended position. When the device is not in use, the support may be retracted so as to be protected from being damaged during transport. Still further, the device is manufactured of a polymeric material and the motor and bearings of the device are sealed. As a result, the device may be easily and safely cleaned using a liquid solution applied by a high pressure device such as a hose.

What is needed is a portable hatch fan which fits adjustably into a variety of hatch openings for boats and recreational vehicles, attaches securely to the hatch opening, and plugs into the boat or vehicle electrical system, which fan is easily attachable to any of a variety of sizes of hatch openings with the hatch cover up and is easily removed from the hatch opening for closing the hatch cover.

BRIEF SUMMARY OF THE INVENTION

An object of the present invention is to provide a portable hatch fan which fits adjustably into a variety of hatch openings for boats and recreational vehicles, attaches securely quickly and easily to the hatch opening, and plugs into the boat or vehicle electrical system, which fan is easily attachable to any of a variety of sizes of hatch openings with the hatch cover up and is easily removed from the hatch opening for closing the hatch cover.

Another object of the present invention is to provide different versions for different sizes of boats and recreational vehicles and to make each version adjustable within a certain range to accommodate different hatch sizes and deck/roof thickness, so that the existing hatch will not be modified in any way and will function in a normal manner.

One more object of the present invention is to provide a fan which operates on 12 volts DC which is the typical voltage inside boat cabins and RV's, and using a cigarette style plug at the end of a 15 ft. cord to connect to the power. One obvious source is the light wiring which exists in all cabins and coaches.

A related object of the present invention is to provide an additional converter plug since in many cases, the fan will be in use when the boat is moored at a dock or when the recreational vehicle is parked in a campground and the present invention in both cases can be plugged into the 110-volt power provided at the dock or campground, which is converted to 12 volts DC as needed so that in this situation, battery charge depletion is not an issue.

Another objective of the present invention is to minimize the protrusion of the fan below the ceiling of the recreational vehicle or boat.

In brief, the present invention is a portable lightweight appliance that is designed to be used during warm weather to significantly reduce the temperature in enclosed cabins. It should be removed and the hatch closed when conditions such as rain exist or the boat or recreational vehicle is underway. This is not viewed as a deterrent since boat and RV owners are in the habit of closing hatches when necessary and the removal of the fan will only add one quick step to the process.

The present invention is easily and quickly installed into and removed from the hatch by twisting two knobs 180 degrees and plugging or unplugging the cord to the power source. When initially installing the present invention, the two clamps are adjusted vertically to accommodate the thickness of the hatch. Then the clamps and guides are slid horizontally to accommodate the width and length of the hatch opening which may or may not be the same dimension. Finally, the provided filler panels are cut to length based on the locations of the guides and clamps and are affixed over the adjustment slots using double sided tape. The fan is now ready for installation and enjoyment.

The fan of the present invention weighs less than seven pounds in the 20 inch by 20 inch model and less for smaller models, and does not produce annoying noise as with the use of rooftop air conditioning units, which irritate close neighbors. Therefore, the present invention can be used at night during sleep time without disturbing anyone. The fan provides immediate gratification once it is adjusted and plugged in.

The present invention after installation protrudes less than three inches below the ceiling of the of the recreational vehicle or boat.

There are existing devices available to suspend the power cord of the present invention from the fan bezel to wall of cabin so the cord is out of the way.

An advantage of the present invention is that the fan quickly and easily clamps to the existing hatch of a boat or recreational vehicle from within the cabin. The user can install the fan while maintaining his privacy. When not in use, since the fan is attached inside the cabin or recreational vehicle, it is conveniently in close proximity to its storage location.

A further advantage of the present invention is that the fan draws fresh outside air and blows it into the cabin at 500 cubic feet per minute on high using a small amount of power while replacing the air in a large 20 ft long×8 ft wide×7 ft tall cabin in 3 minutes.

A related advantage of the present invention is that the air flow is adjustable, allowing initial evacuation on high and then reverting to a slower speed for maintenance. Set to low, the fan will move 250 cubic feet per minute ventilating the same cabin every 5 minutes (12 times per hour). This allows the user great flexibility balancing required air flow against power consumption when campground or shore power are not available.

One more advantage of the present invention is that because of the aggressive airflow, it removes cooking odors and stale musty smells along with moisture build up which tend to accumulate in confined spaces.

Yet another advantage of the present invention is that it is adjustable for different hatch thicknesses and openings.

Still another advantage of the present invention is that it is easily attached to an existing hatch in less than 10 seconds and requires no alteration of the hatch or any other major component of the boat or recreational vehicle.

One additional advantage of the present invention is that it is light weight with a 20 inch model ways less than 7 pounds.

A further advantage of the present invention is that takes up relatively little space and can be stored out of sight when not in use.

Additionally the present invention is pleasing to the eye and does not detract from the cosmetic qualities of the cabin.

A money saving advantage of the present invention is that it uses a high efficiency motor with low power consumption. Another related advantage of the present invention is that the components are adapted to resist the effects of salt air and moisture to prolong the life of the invention.

A convenient advantage of the present invention is that it operates on readily available 12 volt DC power or may be converted to 110 volts AC by the use of an inverter.

Another low maintenance advantage of the present invention is that surfaces of the present invention which come in contact with the boat or RV are padded to prevent marring.

Another advantage of the present invention is that it latches securely and cannot be removed without damaging the unit unless it is unlatched properly.

Another advantage of the present invention is that it protrudes from the ceiling less than 3 inches.

A final advantage of the present invention is that it provides quiet operation.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
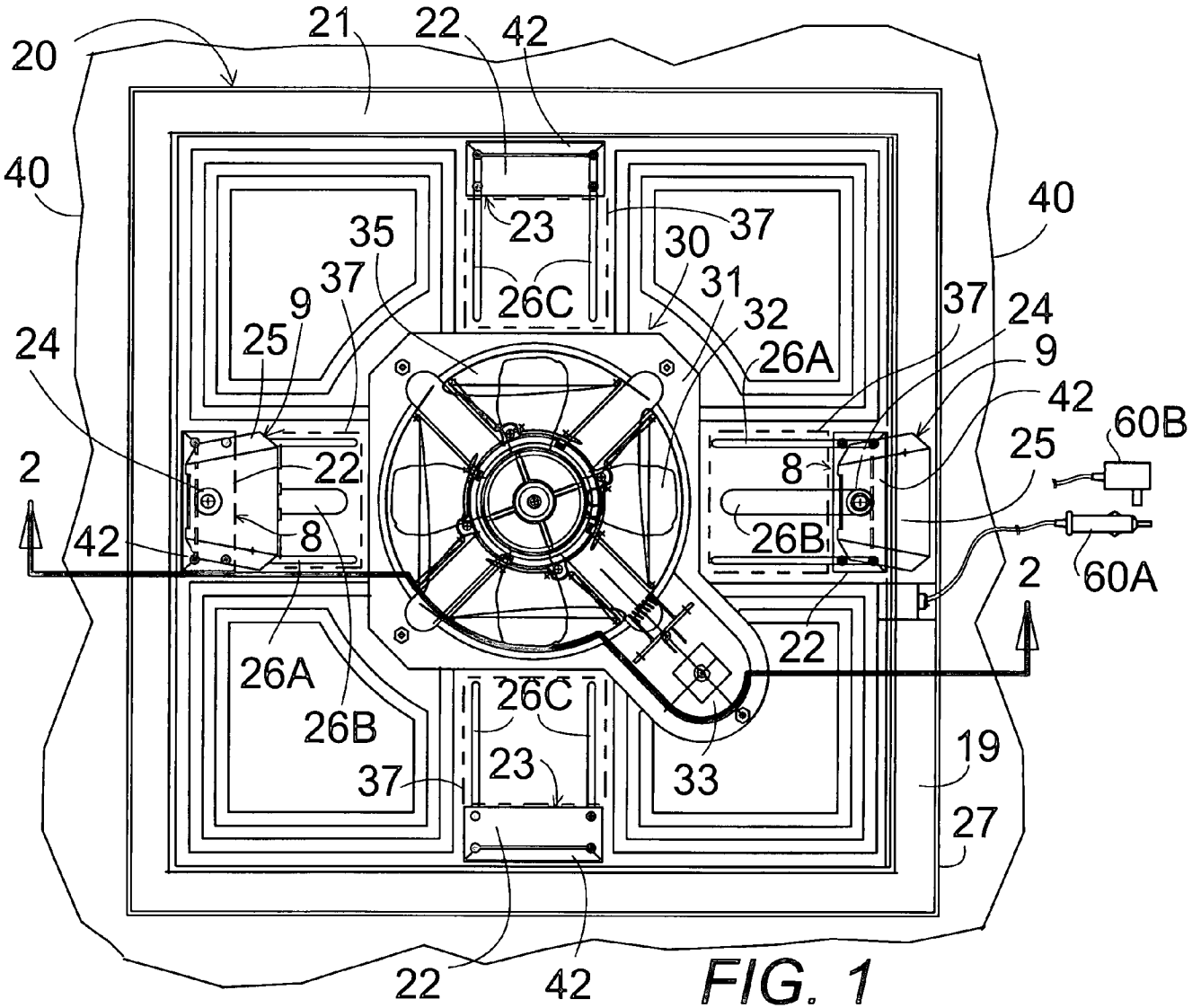
FIG. 1 is a top plan view (exterior showing latching mechanism) of the portable removable hatch fan of the present invention.
Figure 2:
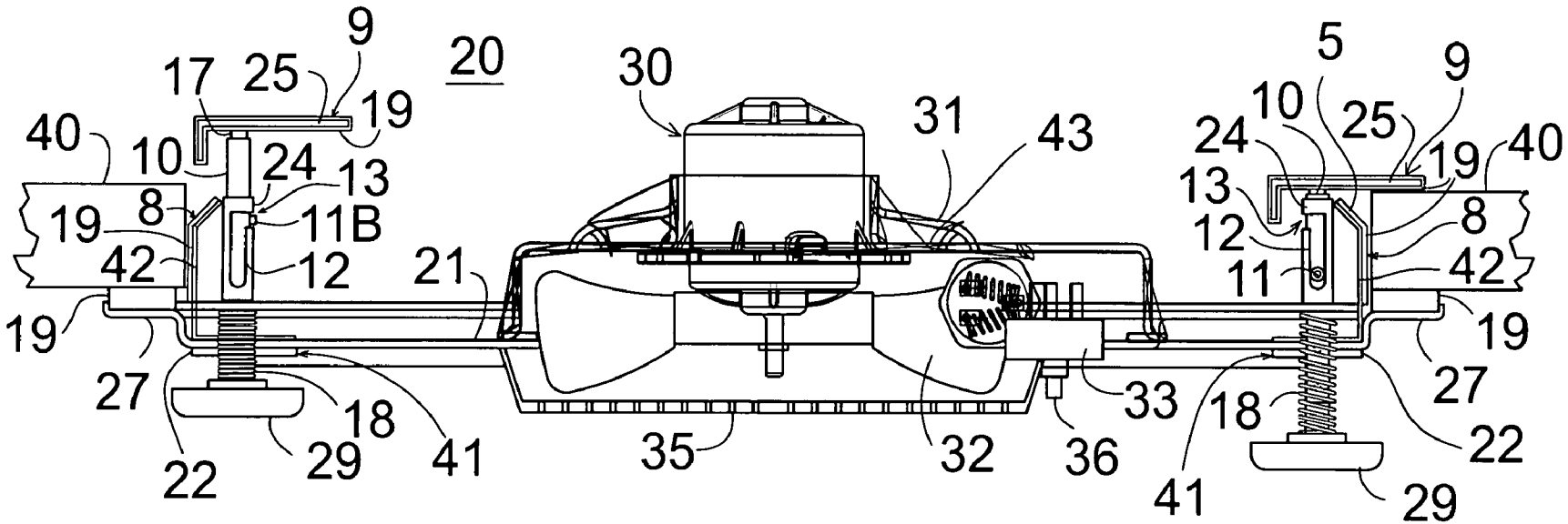
FIG. 2 is an elevational cross-sectional view taken through 2—2 of the hatch fan of FIG. 1.

In FIGS. 1 and 2, a portable hatch fan device 20 fits adjustably into a variety of types and sizes of hatch openings 40 on boat decks and recreational vehicle roofs.

In FIGS. 1 and 2, a fan holder frame 21 comprises a center fan holding structure 31 for securing a motor 30 and fan blade 32 to the fan holder frame 21, and a peripheral frame edge 27 having a flat horizontal top surface with a padded top 19. The padded material 19 is positioned between the top surface of the peripheral frame edge 27 and the bottom surface of a hatch frame 40 surrounding a hatch opening, thereby preventing damage to the hatch frame 40. The fan holder frame 21 also comprises one or more tracks 26A adjacent to each side edge of the fan holder frame 21 perpendicular to the edge. The fan holder frame 21 further comprises an additional wider track 26B adjacent to two opposing side edges.

In FIGS. 1–4, a pair of clamps 9 each attached by a slidable and lockable guide plate connection 22 to the wide slot track 26B on each of two first opposing side edges of the fan holder frame 21 so that each of the pair of clamps 9 is slidable in the track 26B to position the clamp 9 adjacent to one of two first opposing hatch frame sides 40 of any of a variety of hatch frame opening 40 sizes. Each of the pair of clamps 9 is lockable in the track 26B in a desired position for engaging the hatch frame side 40. The slidable and lockable guide plate connection 22 comprises a pair or more of threaded fasteners (not shown) and interconnecting the clamp 9 to the slot 26B.

Each of the pair of clamps 9 further comprises a clamp base sleeve 24 lockable to a wide track 26B and a vertical post 17 having a horizontal clamp plate 25 attached to the top of the vertical post 17. The vertical post 17 attaches to the clamp base sleeve 24 by a means for vertically sliding and horizontally pivoting the vertical post 17 relative to the clamp base sleeve 24. A means is provided, such as a spring 18, for biasing the vertical post 17 normally in a downward position under tension so that the horizontal clamp plate 25 is movable between a first position, as shown by the right clamp 9 in FIG. 2, and second position indicated by the left clamp 9 in FIG. 2. In the first position the clamp plate 25 is biased against a top surface of any of a variety of thicknesses of hatch frames 40. The clamp post 17 is adjustable in height to engage the top surface of the frame side 40 of the one of the two first opposing hatch frame sides 40, thereby sandwiching the hatch frame 40 between the horizontal clamp plate 25 and the peripheral frame edge 27 to secure the portable hatch fan device 20 to the hatch frame 40. In the second position the horizontal clamp plate 25 is elevated above the hatch frame 40 and pivoted horizontally out of alignment with the hatch frame 40, as shown by the left clamp 9 in FIG. 2, to allow the fan 30 to be moved into or out of the hatch 40. Padding material 19 is provided on the surface of the horizontal clamp plate 25, allowing the padding material 19 to be positioned between the clamp plate 25 and the top of the hatch frame 40 and between the clamp base sleeve 24 and the vertical edge of the hatch frame 40, to protect the hatch frame 40 from damage.

Figure 3:
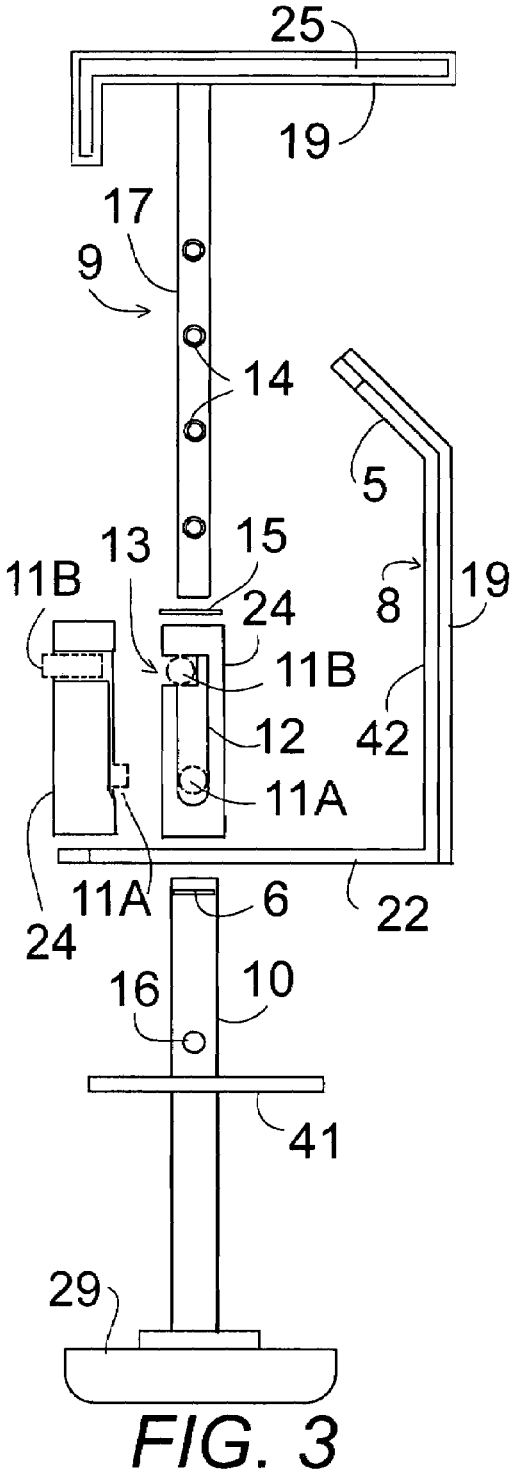
FIG. 3 is a broken front elevational view of the components of the clamp of the hatch fan of FIG. 1 aligned for assembly with the base sleeve shown in front elevational view and side elevational view and the threaded fastener shown dashed in both the lowered position 11A in the vertical slot for clamping and the elevated pivoted position 11B for installation and removal of the hatch fan.
Figure 4:
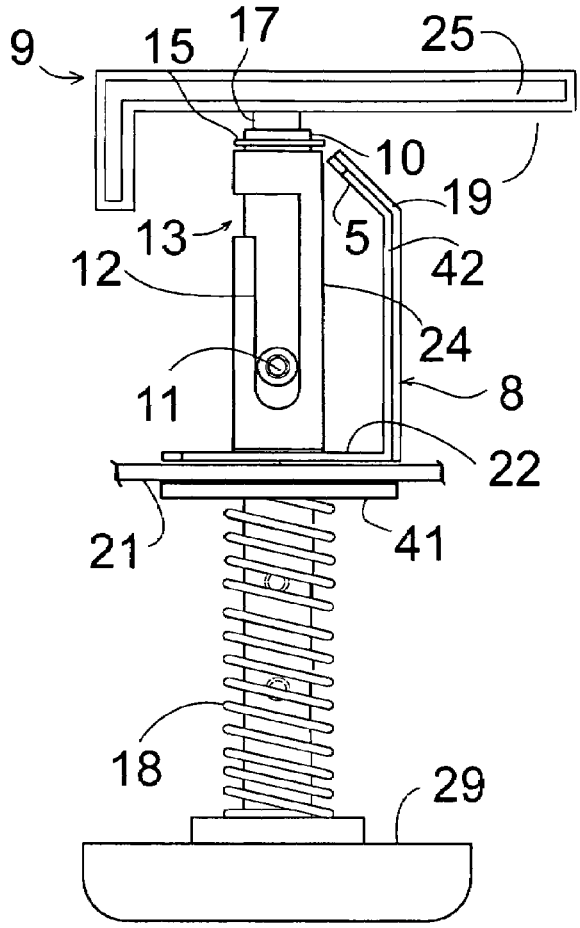
FIG. 4 is a side elevational view of the clamp of the hatch fan of FIG. 1 in a closed position clamped down on a hatch frame.
Figure 5:
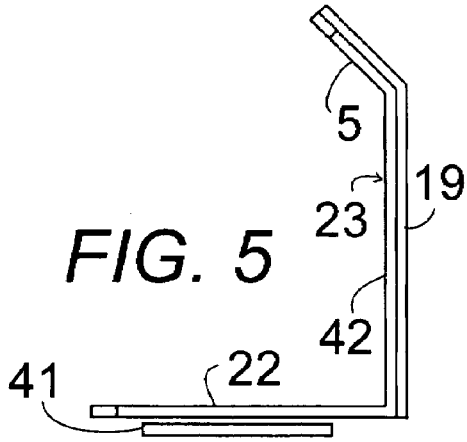
FIG. 5 is a side elevational view of a guide plate.

In FIGS. 3 and 4, the pair of clamps 9 each have a clamp base sleeve 24 comprising a base sleeve having a hollow base sleeve interior, an elongated exterior vertical slot 12 along a portion of the length of the base sleeve, and a horizontal slot 13 around the base sleeve intersecting the vertical slot 12 at a top of vertical slot 12 with both slots communicating with the hollow base sleeve interior.

The pair of clamps 9 each further comprise a vertical post 17 having a post sleeve 10 with a hollow post sleeve interior, the post sleeve 10 having at least one circular opening 16 communicating with the post sleeve 10 interior. A vertical post 17 fits slidably within the post sleeve 10. The vertical post 17 has a series of spaced circular openings 14 along its length to mate one at a time with the post sleeve opening 16. A threaded fastener 11 is threaded alternately through the post sleeve circular opening 16 and one of the vertical post circular openings 14 to interconnect the post sleeve 10 and the vertical post 17 and to create different overlapping relationships of the vertical post 17 and the post sleeve 10 to alter the length of the vertical post 17 to adjust the height of the clamp plate 25 to fit hatch frames 40 of various thicknesses. The threaded fastener 11 extends outside of the post sleeve 10 and rides in the vertical and horizontal slots (12 and 13 respectively) of the clamp base sleeve 24 on the vertical post 17. The post sleeve 10 has a circular groove 6 at the top which receives a clip 15 on post sleeve 10 for limiting the downward movement of the post sleeve in the clamp base sleeve 24.

A bottom section of the vertical post 17 extends downwardly through an elongated slot 26B in the hatch fan holder frame 21 to a point below the hatch fan holder frame 21. A clamp control knob 29 is secured to the bottom section of the post sleeve 10 and is spaced apart from the hatch fan holder frame 21 to control the vertical and pivotal movement of the vertical post 17 within the clamp base sleeve 24. A coil spring 18 is attached around the bottom section of post sleeve 10 between the clamp base sleeve 24 and the clamp control knob 29, thereby normally biasing the clamp control knob 29, the vertical post 17, and the clamp plate 25 downwardly to engage the clamp plate 25 with the top of the hatch frame 40.

The clamp plate 25 is attached to the vertical post 17 so that with the clamp plate 25 in a first position clamped onto the hatch frame 40, as shown by the right clamp 9 in FIG. 2 the threaded means 11 is in the vertical slot 12, as further illustrated by 11A in FIG. 3. When the clamp plate 25 is elevated, the threaded means 11 moves vertically in the vertical slot 12, and when the clamp plate 25 is pivoted horizontally to clear the hatch frame 40 the threaded fastener 11 moves horizontally in the horizontal slot 13, as shown by 11B in FIG. 3. The horizontal slot 13 covers a 180 degree arc around the clamp base sleeve 24 so that in the second position, as shown by the left clamp 9 in FIG. 2, the clamp plate 25 is pivoted 180 degrees from the first position of the clamp plate 25, indicated by the right clamp 9 in FIG. 2.

In FIGS. 1–4, one guide plate 8 is permanently attached to each clamp base sleeve 24. Further, each clamp guide plate 8 is attached by a slidable and lockable guide plate connection 22 to a pair of tracks 26A on opposing edges of the fan holder frame 21 so that each of the clamp guide plates 8 is slidable in the tracks 26A to position the guide plate 8 in contact with one of the two hatch frame sides ~40 of any of a variety of hatch frame opening 40 sizes.

In FIGS. 1–5, two guides 23 are each attached by a slidable and lockable guide plate connection 22 to a pair of tracks 26C on opposing edges of the fan holder frame 21 so that each guide 23 is slidable in the tracks 26C to position guide 23 in contact with two hatch frame sides 40 of any variety of hatch frame opening 40 sizes.

Each of the clamp guide plates 8 and the guides 23 is lockable in the tracks 26A and 26C in a desired position for engaging an inner face of the hatch frame side 40 so that the clamp guide plates 8 and the guides 23 guide the portable hatch fan device 20 during installation to center the fan 30 in the hatch 40 for blowing outside air into an interior space with a hatch cover open. The slidable and lockable guide plate connection 22 comprises four threaded fasteners (not shown) and a base plate 41 interconnecting the guide plate 8 or guide 23 to the pair of spaced grooves 26A or 26C. The device 20 is removable to allow closure of the hatch cover (not shown). The clamp guide plates 8 and guides 23 further comprise a flat vertical hatch frame engaging surface 42 and a padding material 19 on the vertical surface 42 of the guide plate 8 and guide 23. The padding material 19 is positioned between the guide plate 8 and guide 23 and the side of the hatch frame 40, to prevent damage to the hatch frame 40 during installation or removal of the device 20. Each guide plate 8 and guide 23 further comprises a tapered top edge 5 to assist in guiding the portable hatch fan device into the hatch after initially locking into the track.

The hatch fan device 20 of the present invention does not affect the functionality of the existing hatch 40 in any way. When the hatch fan device 20 is removed, the hatch 40 can be closed in a normal fashion. The clamp 9 of the hatch fan device 20 is adjustable to a wide variety of hatch frame 40 thicknesses and the slidable and lockable hatch clamps 9 and clamp guide plates 8 are adjustable to a wide variety of hatch opening 40 sizes.

In FIGS. 1 and 2, the fan 30 provided in the device 20 comprises an electric motor fan 30. The fan 30 has an electrical connector, which may be a DC type cigarette lighter plug 60A to plug into a boat or vehicle electrical system or a AC to DC converter type plug 60B for connecting to an AC power source at a dock or campground space.

A finger shield screen 35 covers the bottom of the fan assembly to prevent contact with the fan blades 32. An additional finger guard screen 43 covers the back side of the fan and is attached to the center fan holding structure 31. A fan control box 33 with control knob or knobs 36 is positioned on the bottom side for ease of access in controlling the speed and duration of the fan from within the boat cabin or RV interior.

Filler panels 37 are affixed, preferably by an adhesive, to the fan holder frame 21, after positioning the guides and clamps in the desired locations for the hatch, to cover slots 26C adjacent to the guides 23 and the slots 26A and 26B adjacent to clamps 9.

A fan holder frame 21 completely encloses the hatch except for the fan opening in the center, thereby preventing pressurized air from the fan from escaping backward through the hatch rather than moving to designated door and window openings.

In use, the hatch cover (not shown) is opened and the hatch fan device 20 with the clamp plates 25 up and pointing inward is installed in the open hatch 40 from inside the boat or RV with the fan holder peripheral frame edge flat against the bottom of the hatch frame 40. When first installed the height of the vertical post 17 may need to be adjusted to fit the thickness of the hatch frame 40. To adjust the height of the vertical post 17 the threaded fastener 11 is threaded alternately through the post sleeve circular opening 16 and one of the post circular openings 14 to interconnect the post sleeve 10 and the post 17 and to create an overlapping relationship of the post 17 and the post sleeve 10 to alter the length of the vertical post 17. Additionally, during the first installation the hatch clamps 9 and guides 23 are all horizontally adjusted to contact the sides of the hatch frame 40 and locked in place with the fan 30 centered in the hatch opening 40. Subsequent installations of the device 20 in the same hatch 40 do not require horizontal adjustment of the clamps 9 and guides 23 or adjustment to the height of the vertical post 17.

After positioning the hatch fan device 20 in the open hatch 40 by using the four base plates 41, the clamp control knobs 29 are turned 180 degrees to position the clamp plates 25 over the hatch frame 40 and to align the threaded fastener 11 on the vertical post 17 with the vertical slot 12 in the clamp base sleeve 24, the clamp control knobs 29 are then lowered by the force of the springs 18 to clamp the clamp plates 25 down on the top of the hatch frame 40. The fan 30 is plugged in and turned on at an adjustable rate of speed for instant air circulation in the boat cabin or interior of the RV bringing in outside air. Each time the hatch fan device 20 is removed from the hatch opening 40 the clamp control knobs 29 are pushed up and pivoted 180 degrees one at a time with one hand while the other hand holds and lowers the hatch fan device 20 to remove it from the hatch opening 40 to allow the hatch cover to be closed. The electrical connection is disconnected and the hatch fan device 20 is stored.

It is understood that the preceding description is given merely by way of illustration and not in limitation of the invention and that various modifications may be made thereto without departing from the spirit of the invention as claimed.

What is claimed is:

1. A portable hatch fan device which fits adjustably and removably into a variety of types and sizes of hatch openings on boat decks and recreational vehicle roofs, the device comprising:

a fan holder frame comprising a center fan holding structure for securing a motorized fan to the fan holder frame and a peripheral frame edge configured to contact a hatch frame;

at least one pair of clamps each of the clamps slidably attached to the fan holder frame to position the clamp adjacent to one of at least two first opposing hatch frame sides of any of a variety of hatch frame opening sizes, each of the clamps lockable in a desired position for engaging the hatch frame side; each of the clamps comprising a spring loaded clamp post and a horizontal clamp plate attached to the clamp post so that the horizontal clamp plate is movable between a first position biased against a surface of the hatch frame of a hatch having any of a variety of thicknesses of hatch frames to sandwich the hatch frame between the horizontal clamp plate and the peripheral frame edge to secure the portable hatch fan device to the hatch frame and a second position elevated above the hatch frame and pivoted horizontally out of alignment with the hatch frame to allow the fan to be moved into or out of the hatch; and at least one pair of guide plates each of the guides slidably attached to the fan holder frame to position the clamp adjacent to one of at least two second opposing hatch frame sides of any of a variety of hatch frame opening sizes, each of the guide plates lockable in a desired position for engaging the hatch frame side for engaging an inner face of the hatch frame side so that the pair of guide plates work in conjunction with the pair of clamps to guide the portable hatch fan device during installation to center the fan in the hatch for blowing outside air into an interior space with a hatch cover open, the device being removable to close the hatch cover.

2. The device of claim 1 wherein each of the guide plates is slidably attached to the fan holder frame by a pair of spaced slots perpendicular to a side edge of the fan holder frame and at least one pair of threaded fasteners interconnecting the guide plate to the pair of spaced slots, the guide plate being removably lockable in place by the at least one pair of threaded fasteners.

3. The device of claim 1 wherein each of the clamps is slidably attached to the fan holder frame by at least one slot perpendicular to a side edge of the fan holder frame and at least one threaded fastener between the clamp and the at least one slot and the clamp is removably lockable in place by the at least one threaded fastener.

4. The device of claim 1 further comprising a padding material on the peripheral frame edge, the padding material positioned between the peripheral frame edge and the hatch frame.

5. The device of claim 1 further comprising a padding material on the clamp plate, the padding material positioned between the clamp plate and the hatch frame.

6. The device of claim 1 wherein guide plate further comprises a flat vertical hatch frame engaging surface and further comprising a padding material on the vertical surface of the guide plate, the padding material positioned between the clamp guide plate and guide and the side of the hatch frame.

7. The device of claim 1 wherein the fan comprises an electric motor fan and further comprising an electrical connector to an AC power source and an electric connector to a DC power source.

8. The device of claim 1 wherein the fan holder frame encloses the hatch around the fan opening preventing pressurized air from the fan from escaping backward through the hatch rather than moving to designated door and window openings.

9. The device of claim 1 further comprising filler panels attachable to the fan holder frame to cover the slots adjacent to the guides and the slots adjacent to the clamps after positioning the guides and clamps in the desired locations for the hatch size.

10. A portable hatch fan device which fits adjustably into a variety of types and sizes of hatch openings on boat decks and recreational vehicle roofs, the device comprising:

a fan holder frame comprising a center fan holding structure for securing a motorized fan to the fan holder frame and a peripheral frame edge having a flat horizontal top surface to contact a bottom surface of a hatch frame surrounding a hatch opening, and at least one track adjacent to each side edge of the fan holder frame perpendicular, to the edge;

a pair of clamps each attached by a slidable and lockable guide plate connection to at least one track on each of two first opposing side edges of the fan holder frame so that each of the pair of clamps is slidable in at least one track to position the clamp adjacent to one of two first opposing hatch frame sides of any of a variety of hatch frame opening sizes, each of the pair of clamps lockable in the track in a desired position for engaging the hatch frame side; each of the pair of clamps comprising a clamp base sleeve lockable to the track and a vertical post having a horizontal clamp plate attached to a top of the vertical post, the vertical post attached to the clamp base sleeve by a means for vertically sliding and horizontally pivoting the vertical post relative to the clamp base sleeve, and a means for biasing the vertical post normally in a downward position under tension so that the horizontal clamp plate is movable between a first position biased against a top surface of the hatch frame of a hatch having any of a variety of thicknesses of hatch frames, the clamp post adjustable in height to engage a top surface of the frame side of the one of the two first opposing hatch frame sides sandwiching the hatch frame between the horizontal clamp plate and the peripheral frame edge to secure the portable hatch fan device to the hatch frame and a second position elevated above the hatch frame and pivoted horizontally out of alignment with the hatch frame to allow the fan to be moved into or out of the hatch; and a pair of clamp guide plates permanently attached to the clamp base sleeve and each attached by a slidable and lockable guide plate connection to at least one track on each of two second opposing side edges of the fan holder frame so that each of the pair of clamp guide plates being slidable in the at least one track to position the guide plate in contact with one of two second opposing hatch frame sides of any of a variety of hatch frame opening sizes, each of the pair of clamp guide plates being lockable in the track in a desired position for engaging an inner face of the hatch frame side so that the pair of clamp guide plates work in conjunction with the pair of clamps plates to guide the portable hatch fan device during installation to center the fan in the hatch for blowing outside air into an interior space with a hatch cover open, the device being removable to close the hatch cover;

a pair of guides each attached by a slidable and lockable guide connection to at least one track on each of two second opposing side edges of the fan holder frame so that each of the pair of guides being slidable in at least one track to position the guide in contact with one of two second opposing hatch frame sides of any of a variety of hatch frame opening sizes, each of the pair of guides being lockable in the track in a desired position for engaging an inner face of the hatch frame side so that the pair of guides work in conjunction with the pair of clamp guide plates to guide the portable hatch fan device during installation to center the fan in the hatch for blowing outside air into an interior space with a hatch cover open, the device being removable to close the hatch cover.

11. The device of claim 10 wherein the pair of clamps each comprises a clamp base sleeve having a hollow base sleeve interior and an elongated exterior vertical slot along a portion of the length of the base sleeve and a horizontal slot around the base sleeve intersecting the vertical slot at a top of the base slot with both slots communicating with the hollow base sleeve interior; the post sleeve having a hollow interior, the vertical post having a series of vertically spaced circular openings along the length of the vertical post communicating with the post sleeve interior, the vertical post fitting slidably within the post sleeve, the post sleeve having at least one circular opening therein, a threaded fastener threaded alternately through any of the vertical post circular openings and the vertical post circular opening to interconnect the post sleeve and the vertical post and to create different overlapping relationships of the vertical post and the post sleeve to alter the length of the vertical post to adjust to hatch frames of various thicknesses, the threaded fastener extending outside of the post sleeve, the threaded fastener riding in the vertical and horizontal slots of the clamp base sleeve, a bottom section of the post sleeve extending downwardly through an elongated slot in the hatch fan frame to a point below the hatch fan frame, a clamp control knob secured to the bottom section of the post sleeve spaced apart from the hatch fan frame to control the vertical and pivotal movement of the vertical post within the clamp base sleeve, and a coil spring attached around the bottom section of the post sleeve between the clamp base sleeve and the control knob normally biasing the control knob, the post sleeve, vertical post and the clamp plate downwardly to engage the clamp plate with the top of the hatch frame, the clamp plate attached to the vertical post so that with the clamp plate in a first position clamped onto the hatch frame the threaded means is in the vertical slot and when the clamp plate is elevated the threaded means moves vertically in the vertical slot, and when the clamp plate is pivoted horizontally to clear the hatch frame the threaded fastener moves horizontally in the horizontal slot.

12. The device of claim 11 wherein the horizontal slot covers a 180 degree arc around the clamp base sleeve so that the second position of the clamp plate is pivoted 180 degrees from the first position of the clamp plate.

13. The device of claim 10 wherein the at least one track comprises a pair of spaced slots perpendicular to the side edge of the fan holder frame and the slidable and lockable guide plate connection to at least one track comprises at least a pair of threaded fasteners and base plate interconnecting the clamp to the pair of spaced slots.

14. The device of claim 10 wherein the at least one track comprises a pair of spaced slots perpendicular to the side edge of the fan holder frame and the slidable and lockable guide connection to the at least one track comprises at least a pair of threaded fasteners and base plates interconnecting the guide to the pair of spaced slots.

15. The device of claim 10 further comprising a padding material on the flat horizontal top surface of the peripheral frame edge, the padding material positioned between the top surface and the hatch frame.

16. The device of claim 10 further comprising a padding material on the surface of the horizontal clamp plate, the padding material positioned between the clamp plate and the top of the hatch frame.

17. The device of claim 10 wherein the clamp guide plate and guide further comprises a flat vertical hatch frame engaging surface and further comprising a padding material on the vertical surface of the guide plate, the padding material positioned between the clamp guide plate and guide and the side of the hatch frame.

18. The device of claim 10 wherein the fan comprises an electric motor fan and further comprising an electrical connector to an AC power source and an electric connector to a DC power source.

19. The device of claim 10 wherein a fan holder frame encloses the hatch around a fan opening preventing pressurized air from the fan from escaping backward through the hatch rather than moving to designated door and window openings.

20. The device of claim 10 further comprising filler panels attachable to the fan holder frame to cover the slots adjacent to the guides and the slots adjacent to the clamps after positioning the guides and clamps in the desired locations for the hatch size.

* * * * *